United States Patent [19]

Smirnov et al.

[11] 3,952,271

[45] Apr. 20, 1976

[54] ELECTROMAGNETIC DEVICE USING HERMETICALLY SEALED CONTACTS

[76] Inventors: Vladimir Alexeevich Smirnov, ulitsa Lavochkina, 52, kv. 208; Vadim Nikolaevich Shoffa, ulitsa Tashkentskaya, 15/22, kv. 288, both of Moscow, U.S.S.R.

[22] Filed: Sept. 13, 1974

[21] Appl. No.: 505,981

[52] U.S. Cl. ..... 335/151; 335/154

[51] Int. Cl.[2] ..... H01H 1/66

[58] Field of Search ..... 335/151, 152, 153, 154

[56] References Cited

UNITED STATES PATENTS

| | | | |
|---|---|---|---|
| 2,264,124 | 11/1941 | Schreiner | 335/151 X |
| 2,834,848 | 5/1958 | Ellwood | 335/154 |
| 2,905,784 | 9/1959 | Ducati | 335/154 |
| 3,366,902 | 1/1968 | Grobe | 335/153 |
| 3,408,603 | 10/1968 | Morrison | 335/151 |

FOREIGN PATENTS OR APPLICATIONS

| | | | |
|---|---|---|---|
| 1,564,124 | 9/1969 | Germany | 335/153 |

*Primary Examiner*—G. Harris

*Attorney, Agent, or Firm*—Haseltine, Lake & Waters

[57] ABSTRACT

The invention relates to hermetically sealed contacts, electromagnetic devices using such contacts, as well as method and means for controlling such electromagnetic devices.

A hermetically sealed contact (reed switch), comprising a capsule enclosing at least two peripheral elastically mounted magnetically controlled cores permanently anchored in the ends of the capsule and a central elastically mounted magnetically controlled core at least partially overlapping the peripheral ones and secured in a supporting member arranged in the capsule intermediate of the inner ends of the peripheral cores, is, according to the invention, characterized by that the supporting member is made elastic and the elasticity thereof is less than the transverse elasticity of the central magnetically controlled core, the latter being secured symmetrically with respect to the elastic supporting member so that when a magnetic flux is applied to the cores, it gives rise to an electromagnetic force of attraction between the magnetically controlled cores, and the central core comes in or out of contact with one of the peripheral cores.

23 Claims, 32 Drawing Figures

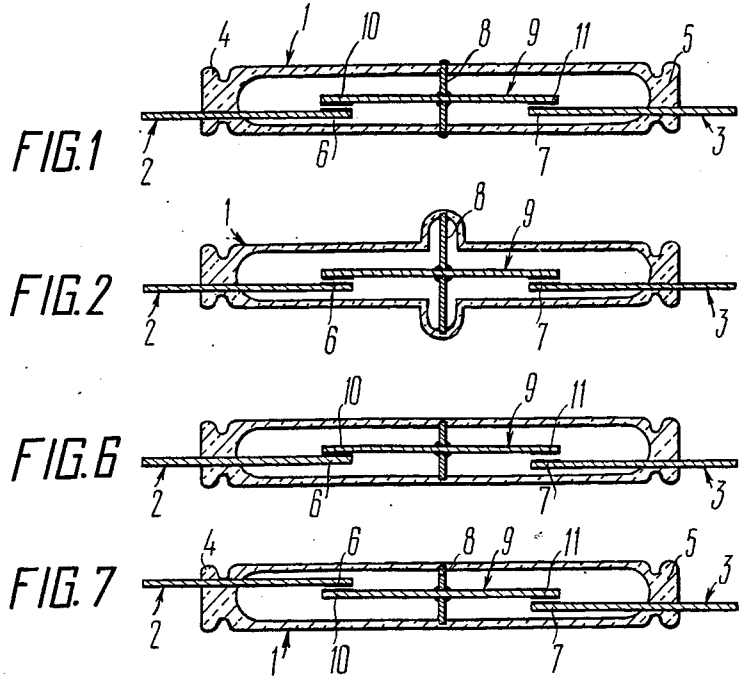
FIG.1
FIG.2
FIG.6
FIG.7
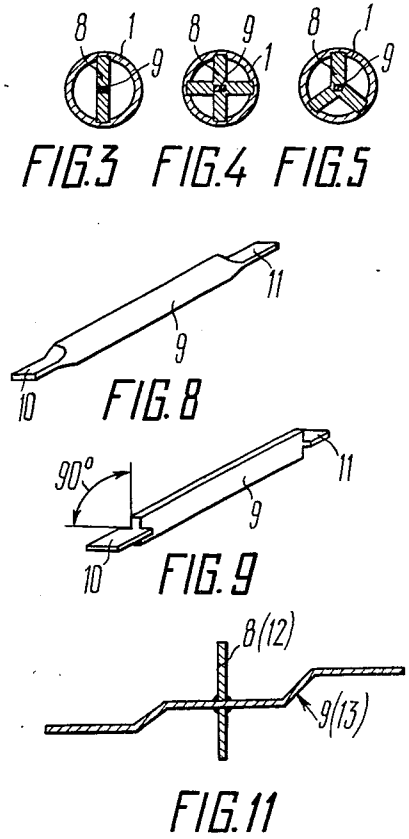
FIG.3
FIG.4
FIG.5
FIG.8
FIG.9
FIG.11
90°

ELECTROMAGNETIC DEVICE USING HERMETICALLY SEALED CONTACTS

The electromagnetic device of the present invention uses the hermetically sealed contact (reed switch) described herein above and comprises at least one magnetizing coil arranged externally of the capsule and connected to a power supply.

The method for controlling an electromagnetic device in accordance with the present invention consists of in that an additional magnetomotive force is applied to the overlapping ends of the central and one of the peripheral magnetically controlled cores in the direction of their closure, and an additional magnetomotive force is derived almost at the moment of contact between the overlapping ends of the central and one of the peripheral cores.

The means for realizing the method of the present invention is characterized in that it comprises at least two additional magnetizing coils whose windings are connected in series between the apices of one of the diagonals of a bridge, each arm of which includes a resistor and a diode connected in series, whereas, connected in series between the apices of the other diagonal of the bridge, are the windings of main magnetizing coils, the common point of the windings of the additional magnetizing coils being connected to the negative terminal of an additional power supply whose positive terminal is connected to that of the main power supply, the common point of the windings of the main magnetizing coils being connected to the negative terminal of the main power supply via a conducting diode, each winding of the additional magnetizing coils being shunted by a capacitor and is arranged on a respective main magnetizing coil in an aiding relationship therewith.

The invention may be advantageously used, in particular, to realize AND and OR functions, as a well as memory function.

The present invention relates to elements used in automatics and computing machinery, and more particularly to hermetically sealed contacts, electromagnetic devices using such contacts, as well as methods and means for controlling such electromagnetic devices. Hermetically sealed contacts are widely known in the art by the designation "reed switches."

Hermetically sealed contacts (reed switches are known which comprises a capsule enclosing elastically mounted magnetically controlled cores: at least two peripheral cores anchored permanently in the ends of the capsule and a central core overlapping the peripheral ones.

Disadvantages inherent in these prior art reed switches are their poor resistance to vibration and the absence of a fixed initial position of the central magnetically controlled core when no control signal is applied thereto.

Also known in the art are hermetically sealed contacts (reed switches) comprising a capsule enclosing at least two peripheral elastically mounted magnetically controlled cores anchored permanently in its ends and a central core overlapping the peripheral ones and secured in a rigid supporting member arranged in the capsule intermediate of the inner ends of the peripheral cores.

These reed switches are disadvantageous in that they have a low operating sensitivity and a low re-setting ratio with the considerable initial gaps which are typical of all known reed switches of the symmetrical type.

There are also known electromagnetic devices using reed switches, comprising at least one magnetizing coil connected to a power supply.

The prior art electromagnetic devices using reed switches suffer from disadvantages residing in a relatively small initial gap between elastically mounted magnetically controlled cores, due to which they may close under the effect of the magnetic field surrounding the cores of the magnetizing coil.

Known in the art are methods for optimally controlling electromagnetic devices using reed switches by applying a bipolar magnetomotive force (ampere-turns) to a magnetizing coil surrounding the overlapping ends of the central and one of the peripheral magnetically controlled cores being closed and deriving another magnetomotive force (ampere-turns) from another magnetizing coil surrounding the overlapping ends of the central and the other peripheral magnetically controlled cores being opened.

This method of optimum control, whereby the vibration of the cores being closed is mitigated, hence the duration of the transient process of closure of the cores is minimized, is disadvantageous in that it is too difficult to achieve.

It is therefore an object of the present invention to provide a hermetically sealed contact with improved resistance to vibration and high responsiveness, as well as with a fixed initial position of the central and peripheral elastically mounted magnetically controlled cores.

A further object of the invention is to provide an electromagnetic device using such hermetically sealed contacts with a wider initial gap between the magnetically controlled cores closing under the effect of the magnetic field of a magnetizing coil.

Still another object of the invention is to provide a method for controlling such electromagnetic devices, which will eliminate vibration of the closing central and peripheral magnetically controlled cores and, consequently, minimize the duration of the transient process of the closure of said cores.

These objects are attained in that in a hermetically sealed contact (reed switch), comprising a capsule enclosing at least two peripheral elastically mounted magnetically controlled cores permanently anchored in the ends of the capsule and a central elastically mounted magnetically controlled core at least partially overlapping the peripheral ones and secured in a supporting member arranged in the capsule intermediate of the inner ends of the peripheral cores, the supporting member is, according to the invention, made elastic and has an elasticity lower than the transverse elasticity of the central magnetically controlled core, and the central magnetically controlled core is secured symmetrically with respect to the elastic supporting member so that when a control magnetic field is applied to the cores, it gives rise to an electromagnetic force of attraction between the magnetically controlled cores, and the central magnetically controlled core comes in or out of contact with one of the peripheral magnetically controlled cores.

The elastic supporting member may be made in the form of a diaphragm having a diameter which is preferably greater than the internal diameter of the capsule, and the capsule is expanded at the site of attachment of the diaphragm thereto, the edges of the diaphragm being accommodated and rigidly fastened in the expanded portion of the capsule. Such a design of the elastic supporting member improves the operating sensitivity of the reed switch.

To simplify the structure of the reed switch, the elastic supporting member should preferably be made in the form of a rectangular strip.

In an alternative embodiment of the reed switch, the elastic supporting member may be made in the form of a symmetric cross or a symmetric three-pointed star, which precludes spontaneous closure of the cores under the action of mutually perpendicular vibrations.

To increase the breakdown voltage, the central magnetically controlled core should preferably be arranged on one side of the inner ends of the peripheral magnetically controlled cores.

To render the reed switch more versatile, the central magnetically controlled core should be arranged so as to provide for a normally closed contact between the central core and one of the peripheral cores.

A higher responsiveness will be ensured if the central magnetically controlled core is arranged intermediate of the peripheral core ends overlapping the central core.

In a hercon wherein the contact cores should remain closed when the control action discontinues, the central and peripheral cores should be made from a magnetically remanent material.

To simplify and facilitate the process of manufacture of the proposed reed switch, the mid portion of the central magnetically controlled core is made circular in cross section, while its ends are made flat.

To enhance the rigidity of the central magnetically controlled core with respect to that of the supporting member, it should be made rectangular in cross section, and its ends should form an angle of about 90° with the mid portion thereof.

If the elasticity of the supporting member is commensurate with the transverse elasticity of the central magnetically controlled core, its length should preferably be made equal to the total length of the inner ends of the peripheral magnetically controlled cores.

If the elasticity of the supporting member is substantially lower than the transverse elasticity of the magnetically controlled cores, the length of the central magnetically controlled core should exceed the total length of the inner ends of the peripheral magnetically controlled cores.

To make the reed switch more versatile, it should comprise at least one additional supporting member arranged between the ends of the central and one of the peripheral magnetically controlled cores with an additional central magnetically controlled core being rigidly secured therein.

To increase the current being switched over, those portions of the central magnetically controlled cores which are confined between the elastic supporting members are made from a conducting nonferromagnetic material.

To cut down the size of the reed switch, it is expedient that each central magnetically controlled core be made bent and stepped, and it should preferably be secured in the centre of the supporting member at its mid portion.

To obtain symmetrical characteristics, the reed switch should preferably be made such that the ends of each central magnetically controlled core which are disposed on either sides of the supporting members, are equal in length.

Greater versatility of the reed switch can also be attained if each central magnetically controlled core is provided with a lead.

To form bridging contacts, the hercon should be designed so as to include at least two additional peripheral cores permanently anchored in the ends of the capsule and made from a nonferromagnetic material, and each end of the central magnetically controlled cores should be arranged between the end of a peripheral magnetically controlled core and that of a peripheral core made from a nonferromagnetic material, which ends are anchored in one end of the capsule, so that the central magnetically controlled cores form normally open contacts with the peripheral magnetically controlled cores and normally closed contacts with the cores made from a nonferromagnetic material.

To minimize vibration, the contact surfaces of the central and peripheral magnetically controlled cores should be arranged at an angle, e.g. 30°, to the direction of their mutual displacement.

It is advisable that the electromagnetic device comprising at least one magnetizing coil arranged externally of the capsule and connected to a power supply be based on the inventive reed switch.

To improve the reliability of the electromagnetic device in operation, it should comprise at least two magnetizing coils and a ferromagnetic shunt made in the form of a cylinder and disposed between the ends of the magnetizing coils.

To increase the responsiveness of the electromagnetic device, it should preferably comprise at least one ferromagnetic tube with both of its ends being preferably bevelled in parallel planes inclined with respect to the tube axis, the tube being arranged externally of the capsule and having each of its bevelled ends lying in the longitudinal plane of symmetry of the central magnetically controlled core as well as facing the contact surface of the peripheral magnetically controlled core nearest thereto, a means for displacing the ferromagnetic tube, made as a threaded joint between the ferromagnetic shunt and the ferromagnetic tube, and a rotation preventing means in the form of a key located in keyways made lengthwise in the ferromagnetic tube and the magnetizing coil form.

To increase the drop-off-to-pick-up ratio, the windings of the magnetizing coils should preferably be connected in series with one another and with the switched leads of a non-contact flip-flop, the power supply should be connected between the common point of said windings and the switching lead of the noncontact flip-flop, and the ferromagnetic shunt should be provided with a slot to receive the lead going to the central magnetically controlled core.

To increase the responsiveness without a substantial narrowing of the initial gap, the device should comprise an additional magnetizing coil surrounding the magnetically controlled cores coming in contact and connected to an additional power supply.

To widen the scope of use of the proposed device, particularly to render it capable of performing the functions of a memory, each magnetizing coil in the device should be sectionalized lengthwise.

To ensure vibration-free closure of the magnetically controlled cores, it is advisable that in the method for controlling an electromagnetic device of the above-described type, consisting in that a magnetomotive force (ampere-turns) is applied to the magnetizing coil surrounding the closing ends of the central and peripheral magnetically controlled cores and another magnetomotive force (ampere-turns) is derived from another magnetizing coil which surrounds the opening ends of the central and peripheral magnetically controlled cores, an additional motive force can be obtained in the form of a magnetic flux, preferably produced by the additional magnetizing coil, following the application of the magnetomotive force after a period of time during which the rate of displacement of the closing ends of the central and peripheral magnetically controlled cores reaches its maximum value, which additional magnetomotive force should be applied to the opening ends of the central and peripheral magnetically controlled cores, in the direction of their closure, then removed nearly at the moment of contact between the closing ends of the central and peripheral magnetically controlled cores.

To cut down power consumption, the method for controlling an electromagnetic device should contemplate bringing the value of the magnetomotive force being applied, after removing the additional magnetomotive force, to a preset level determined by the required contact force of the closed ends of the central and peripheral magnetically controlled cores.

To simplify the means for realizing the above method, it should preferably comprise, in addition to two main magnetizing coils, at least two supplementary magnetizing coils shunted by capacitors and connected in series between the apices of one of the diagonals of the bridge each arm whereof includes a resistor and a diode both connected in series, the main magnetizing coils being connected in series between the apices of the other diagonal of the bridge. The common point of the main magnetizing coils should be connected to the negative terminal of the main power supply via a conducting diode, and the common point of the additional magnetizing coils should be connected to the negative terminal of an additional power supply whose positive terminal should be connected to that of the main power supply, each of said additional magnetizing coils being arranged on a respective main magnetizing coil in an aiding relationship therewith.

The herein proposed hermetically sealed contact (reed switch) and electromagnetic device using this contact make it possible to substantially improve resistance to vibration and widen the initial gap between the magnetically controlled cores being closed, while the proposed method and means for controlling an electromagnetic device using a reed switch permit of eliminating vibration of the cores being closed, whereby the duration of the transient process of closure of these cores is minimized.

Moreover, various embodiments of the electromagnetic device using the proposed hermetically sealed contact permit its responsiveness as well as the voltage being switched over and the load current to be substantially increased, and the versatility of the device can be considerably enhanced.

The invention will now be described in greater detail with reference to preferred embodiments thereof, taken in conjunction with the accompanying drawings, wherein:

FIG. 1 shows, in longitudinal section, a hermetically sealed contact with an elastic core supporting member, according to the invention;

FIG. 2 shows another embodiment of the hermetically sealed contact, also in longitudinal section, according to the invention;

FIG. 3 shows an embodiment of the elastic supporting member, according to the invention;

FIG. 4 shows another embodiment of the elastic supporting member, according to the invention;

FIG. 5 shows a third embodiment of the elastic supporting member, according to the invention;

FIG. 6 is a longitudinal section view of an embodiment of the hermetically sealed contact, according to the invention;

FIG. 7 is a longitudinal section view of an embodiment of the hermetically sealed contact, according to the invention;

FIG. 8 is a general view of an embodiment of the central magnetically controlled core, according to the invention;

FIG. 9 is a general view of another embodiment of the central magnetically controlled core, according to the invention;

FIG. 11 is a longitudinal section view of an embodiment of the central magnetically controlled core, according to the invention;

Figures 10, 12, 13, 14, 15, 16:
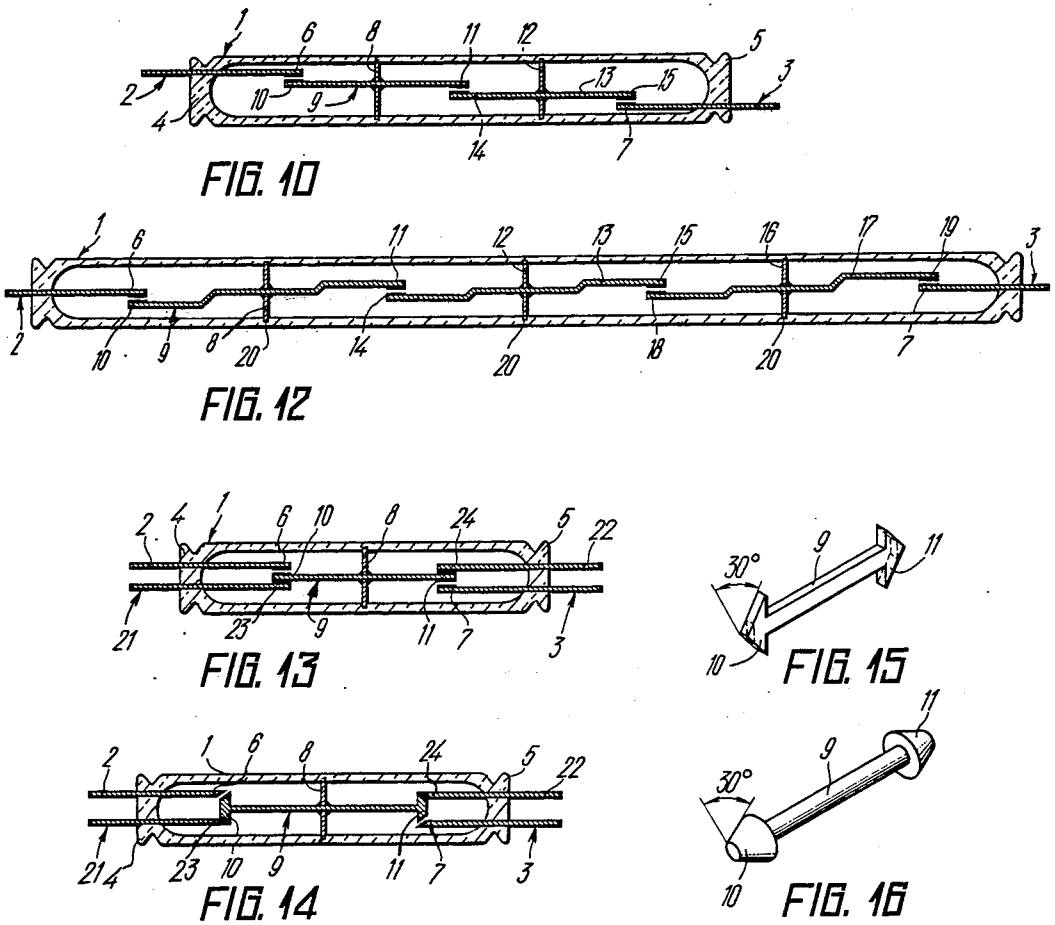
FIG. 10 is a longitudinal section view of an embodiment of the hermetically sealed contact, according to the invention.
FIG. 12 is a longitudinal section view of an embodiment of the hermetically sealed contact, according to the invention.
FIG. 13 is a longitudinal section view of an embodiment of the hermetically sealed contact, according to the invention.
FIG. 14 is a longitudinal section view of an embodiment of the hermetically sealed contact, according to the invention.
FIG. 15 is a general view of an embodiment of the central magnetically controlled core, according to the invention.
FIG. 16 is a general view of an embodiment of the central magnetically controlled core, according to the invention.

Referring now to the drawings, the hermetically sealed contact comprises a sealed glass capsule 1 (FIG. 1) enclosing two peripheral elastically mounted magnetically controlled cores 2 and 3 made from a ferromagnetic material. The peripheral magnetically controlled cores 2 and 3 are permanently anchored in ends 4 and 5, respectively, of the capsule 1. They may be either soldered to or sealed in the ends 4 and 5. Arranged between an end 6 of the peripheral magnetically controlled core 2 and an end 7 of the peripheral magnetically controlled core 3 is a supporting member 8. The supporting member is made from an elastic material and may be either soldered to or sealed in the walls of the capsule 1. Rigidly secured in the supporting member 8 is a central elastically mounted magnetically controlled core 9 which is either soldered to or sealed in the supporting member 8. The central magnetically controlled core 9 has its ens 10 and 11 partially overlapping, respectively, the ends 6 and 7 of the peripheral magnetically controlled cores 2 and 3. The peripheral magnetically controlled cores 2 and 3 are anchored in the ends 4 and 5 of the capsule 1 and the central magnetically controlled core 9 is secured in the supporting member 8 so as to be capable of closing or opening under the action of a magnetic flux.

The contact surfaces of the ends 6 and 7 of the peripheral magnetically controlled cores 2 and 3 and those of the ends 10 and 11 of the central magnetically controlled core 9 are coated with materials featuring high electrical conduction and sufficient mechanical strength, such as silver, rhodium, etc.

The hercon of FIG. 1 operates as follows.

As a motive force in the form of a longitudinal magnetic field is applied to a pair of magnetically controlled cores 2 and 9 or 3 and 9, the contact surfaces 6 and 10 or 11 and 7 are brought together due to the deformation of the supporting member 8 and close. When the longitudinal magnetic field passes over from the closed pair of magnetically controlled cores to the open pair, the latter becomes closed and the former becomes open. This operating principle of the proposed hermetically sealed contact forms the basis of various embodiments of hermetically sealed contacts and electromagnetic devices using them.

The above operating principle is based on the assumption that the elasticity of the supporting member 8 is lower than the transverse elasticity of the central magnetically controlled core 9.

If the elasticity of the supporting member 8 is higher than the transverse elasticity of the central magnetically controlled core 9, simultaneous application of motive forces in the form of longitudinal magnetic fields (or a longitudinal magnetic field) to the pairs of magnetically controlled cores 2 and 9 as well as 3 and 9 causes the contact surfaces 6 and 10 as well as 11 and 7 to be drawn together, due to the deformation of the magnetically controlled cores 2, 3 and 9, and close. When these forces are removed, the pair of magnetically controlled cores 2 and 9 or 3 and 9 is returned to the initial state.

FIG. 2 shows a hercon wherein the supporting member 8 is made in the form of a diaphragm. This diaphragm is slightly greater in diameter than the inner space of the capsule 1, and the latter has an expanded portion to accommodate the diaphragm. The diaphragm has its edges rigidly secured to, e.g. sealed in, this expanded portion of the capsule 1. Rigidly secured to the diaphragm is the central magnetically controlled core 9. The hercon of FIG. 2 operates similarly to that of FIG. 1.

The elastic supporting member 8 may be made in the form of a rectangular strip (FIG. 3) which is arranged in the centre of the capsule 1 symmetrically with its diameter, with the central magnetically controlled core 9 being rigidly secured thereto.

The elastic supporting member 8 may also be made in the form of a symmetric cross (FIG. 4) secured in the capsule 1 in the above-described manner. In this case, the central magnetically controlled core 9 is rigidly secured in the centre of the symmetric cross.

Alternatively, the supporting member 8 may be made in the form of a symmetric three-pointed star (FIG. 5) secured in the capsule 1 with the central magnetically controlled core 9 being rigidly secured in the centre thereof.

The supporting member 8 shaped as a rectangular strip is more elastic, while the supporting member 8 being shaped as a symmetric cross or a symmetric three-pointed star ensures better alignment thereof in the capsule 1 and improves its resistance to vibration.

The hermetically sealed contact shown in FIG. 6 is formed of the same elements as in the above-described embodiments with the difference that the peripheral magnetically controlled core 2 and the central magnetically controlled core 9 are arranged so that the end 10 of the central magnetically controlled core 9 forms a normally closed contact with the end 6 of the peripheral magnetically controlled core 2, while the end 11 of the central magnetically controlled core 9 forms a normally open contact with the end 7 of the peripheral magnetically controlled core 3.

The hermetically sealed contact illustrated in FIG. 6 operates in the following manner. When a motive force in the form of a longitudinal magnetic field is applied to the pair of magnetically controlled cores 3 and 9, the contact surfaces 11 and 7 are brought together, due to the deformation of the supporting member 8, and close. At the same time, the contact surfaces 10 and 6 open. When the longitudinal magnetic field is removed from the pair of magnetically controlled cores 3 and 9 and another longitudinal magnetic field is applied to the pair of magnetically controlled cores 2 and 9, the contact surfaces 6 and 10 are brought to the initial closed state and the contact surfaces 7 and 11 are brought to the initial open state. If the central magnetically controlled core 9 is arranged symmetrically with the supporting member 8, the maximum gaps between the central magnetically controlled core 9 and peripheral magnetically controlled cores 2 and 3 are equal.

It should be noted at this point that in all of the above-described embodiments of the hermetically sealed contact the central magnetically controlled core 9 (FIGS 1, 2 and 6) is secured in the supporting member 8 so that it is disposed on one side of the ends 6 and 7 of the peripheral magnetically controlled cores 2 and 3.

The hermetically sealed contact shown in FIG. 7 consists of the same elements as those described above, but in this case the central magnetically controlled core 9 is secured in the supporting member 8 and the peripheral magnetically controlled cores 2 and 3 are anchored in the ends 4 and 5 of the capsule 1 so that the central magnetically controlled core 9 is arranged between the ends 6 and 7 of the peripheral magnetically controlled cores 2 and 3, respectively.

When a motive force in the form of a longitudinal magnetic field is applied simultaneously to the pair of magnetically controlled cores 2 and 9 as well as the pair of cores 3 and 9, the contact surfaces 6 and 10 as well as 7 and 11 close due to the electromagnetic force of attraction therebetween and the deformation of the supporting member 8, whereby the peripheral magnetically controlled cores 2 and 3 become electrically connected. Removal of the magnetomotive force returns the magnetically controlled cores to the original state. In the embodiment of FIG. 7, the hermetically sealed contact has an initial gap about twice as wide as in the prior art hercons.

In all of the above-described embodiments of the hermetically sealed contact, the central magnetically controlled core 9 and peripheral magnetically controlled cores 2 and 3 can be made from a magnetically remanent material in order to be capable to perform the functions of a memory.

The mechanical strength can be improved by making the central magnetically controlled core 9 circular in cross section (FIG. 8) with the ends 10 and 11 thereof being made flat.

The central magnetically controlled core 9 may also be rectangular in cross section (FIG. 9) with its ends 10 and 11 forming an angle of about 90° with the mid portion thereof. Such an embodiment permits the elasticity of the supporting member 8 to be lower than the transverse elasticity of the central magnetically controlled core 9 when the latter is made longer which substantially improves the responsiveness of the hercon not by narrowing the initial gap, but by lengthening the central magnetically controlled core 9, since with an invariable magnetomotive force the longer the central magnetically controlled core 9, the greater will be the displacement of its end.

In all of the above-described embodiments of the hermetically sealed contact, the length of the central magnetically controlled core 9 is almost equal to or greater than the total length of the inner ends of the peripheral magnetically controlled cores 2 and 3 enclosed in the capsule 1.

The hermetically sealed contact of FIG. 11 comprises, in addition to the above-listed elements 1 through 11, an additional supporting member 12 which is arranged in the capsule 1 intermediate of the end 11 of the central magnetically controlled core 9 and the end 7 of the peripheral magnetically controlled core 3. Rigidly secured in the additional supporting member 12 is an additional central magnetically controlled core 13 with contacting ends 14 and 15. The central magnetically controlled core 9 is secured in the supporting member 8 so that it is arranged between the end 6 of the peripheral magnetically controlled core 2, overlapping the central magnetically controlled core 9, and the end 14 of the additional magnetically controlled core 13, and the additional magnetically controlled core 13 is secured in the additional supporting member 12 so that is is arranged between the end 11 of the central magnetically controlled core 9, overlapping the additional core 13, and the end 7 of the peripheral magnetically controlled core 3. The additional central magnetically controlled core 13 is, like all the other magnetically controlled cores, mounted elastically so that under the effect of a magnetic field its end 14 can come in or out of contact with the end 11 of the central magnetically controlled core 9, while its end 15 can come in or out of contact with the end 7 of the peripheral magnetically controlled core 3. The elasticity of the additional supporting member 12 is lower than the transverse elasticity of the additional central magnetically controlled core 13.

The hercon shown in FIG. 10 operates as follows.

When motive forces in the form of longitudinal magnetic fields are applied to the pairs of magnetically controlled cores 2 and 9 as well as 3 and 13, their contact surfaces 6 and 10 as well as 7 and 15 are drawn together and close. This, in turn, results in a closure of the contact surfaces 11 and 14 of the magnetically controlled cores 9 and 13, due to the deformation of the supporting members 8 and 12. The magnetically controlled cores 9 and 13 being arranged symmetrically with respect to their supporting members 8 and 12 and the initial gap between the contact surfaces 11 and 14 being equal to or slightly less than the total initial gap between the contact surfaces 6 and 10 as well as 7 and 15, the magnetically controlled cores 9 and 13 close, whereby the peripheral magnetically controlled cores 2 and 3 become electrically connected. The magnetically controlled cores 9 and 13 being arranged symmetrically with respect to their supporting members 8 and 12 and the initial gap between the contact surfaces 11 and 14 exceeding the total initial gap between the contact surfaces 6 and 10 as well as 7 and 15, it is only the contact surfaces 11 and 14 that close. The contact surfaces 11 and 14 are further brought closer together until they finally close by applying a motive force in the form of a longitudinal magnetic field to those portions of the magnetically controlled cores 9 and 13 which are between the supporting members 8 and 12.

When the magnetomotive forces are removed, the magnetically controlled cores are brought to the initial state.

Due to the presence in the capsule 1 of the additional supporting member 12 with the additional central magnetically controlled core 13 rigidly secured therein, the axes of the peripheral magnetically controlled cores 2 and 3 manifest a strong tendency to misalignment with the longitudinal axis of the capsule 1.

To eliminate this misalignment, the central magnetically controlled cores 9 and 13 are made bent and stepped and arranged as symmetrically as possible with the supporting members 8 and 12, as is shown in FIG. 11.

FIG. 12 shows a hermetically sealed contact with the central magnetically controlled core 9 and two additional central magnetically controlled cores 13 being made as shown in FIG. 11. Compared to the hercon illustrated in FIG. 10, this hercon comprises a second additional supporting member 16 arranged in the capsule 1 intermediate of the contact surface 15 of the additional central magnetically controlled core 13 and the contact surface 7 of the peripheral magnetically controlled core 3. Rigidly secured in and symmetrically arranged with the additional supporting member 16 is a second additional central magnetically controlled core 17 so that it is located between the contact surface 15 of the additional central magnetically controlled core 13 and the contact surface 7 of the peripheral magnetically controlled core 3. In this case, the additional central magnetically controlled core 17 is elastically mounted in the additional supporting member 16 so that under the action of a magnetic field the contact surfaces 18 and 19 thereof may come in and out of contact, respectively, with the contact surface 15 of the additional central magnetically controlled core 13 and the end 7 of the peripheral magnetically controlled core 7. The operating principle of the hermetically sealed contact shown in FIG. 12 is similar to that of the hercon of FIG. 10 with the difference that it can perform additional functions due to the presence of the additional central magnetically controlled core 17 secured in the additional supporting member 16. For example, if the hercon of FIG. 10 is capable of performing a logical AND function for three inputs only, the hercon of FIG. 12 can perform a logical AND function for four inputs. The versatility of the hermetically sealed contact is further increased by providing the additional central magnetically controlled cores 13 and 17 with leads 20.

In the hermetically sealed contacts shown in FIGS. 10 and 12, those portions of the central magnetically controlled cores 9, 13 and 17 which lie between the supporting members 8, 12 and 16 may be made from an electrically conducting nonferromagnetic material, such as copper.

Due to such an embodiment, the hercon is capable of switching over heavier currents.

The hermetically sealed contact illustrated in FIG. 13 includes the same elements 1 to 11 as the hercon of FIG. 7 plus including two additional peripheral cores 21 and 22 made from a non-ferromagnetic material and which are permanently anchored, in a manner described above, in the ends 4 and 5, respectively, of the capsule 1. In this case, the end 10 of the central magnetically controlled core 9 is disposed between the end 6 of the peripheral magnetically controlled core 2 and an end 23 of the peripheral core 21 made from a nonferromagnetic material, forming a normally closed contact with the latter. The end 11 of the central magnetically controlled core 9 is disposed between the end 7 of the peripheral magnetically controlled core 3, forming a normally open contact therewith, and an end 24 of the peripheral core 22 made from a nonferromagnetic material, forming a normally closed contact therewith.

The hermetically sealed contact shown in FIG. 13 operates in a manner like that shown in FIG. 7. The only difference is that the hercon of FIG. 13 being more complicated in arrangement ensures switching over of the cores under the action of a motive force. When motive forces in the form of longitudinal magnetic fields are applied to the pairs of magnetically controlled cores 2 and 9 as well as 3 and 9, the normally closed contact surfaces 10 and 23 as well as 11 and 24 open. Intensification of the motive forces acting upon said magnetically controlled cores causes the contact surfaces 6 and 10 as well as 11 and 7 to be drawn together and close.

As soon as the motive forces are removed, the hermetically sealed contact (FIG. 13) reassumes its initial state.

The hercon of FIG. 14 is basically similar to that of FIG. 13. There is a difference though, residing in the shape of the contacting ends of the cores. To ensure more reliable contact, the contact surfaces 6, 7, 23 and 24 of the peripheral cores 2, 3, 21 and 22, respectively, form an angle of 30°, preferably, with the direction of displacement of the ends 10 and 11 of the central magnetically controlled core 9.

The ends 10 and 11 of the central magnetically controlled core 9 may have the shape of an arrow, a truncated arrow (FIG. 15) as well as that of a cone or a truncated cone (FIG. 16) with their contact surfaces also forming an angle of 30°, preferably, with the direction of their displacement.

Such a design of the core ends ensures their "lapping" once they are in contact. At the same time, the proposed design makes it possible to have an initial gap equal to the sum of two minimum distances between two pairs of contact surfaces, equal, in turn, to the amount of displacement of only one of the ends of the central magnetically controlled core 9.

The proposed electromagnetic device using the hermetically sealed contact of the present invention may, in one of its embodiments, be built around the hercon of FIG. 1. The capsule 1 (FIG. 17), in this case, has fitted thereon a form 25 of a magnetizing coil 26 with a winding 27. The winding 27 is connected to a power source (not shown).

The electromagnetic device illustrated in FIG. 17 operates in the following manner.

When a control signal is applied to the magnetizing coil 26, a magnetic flux is generated which threads the peripheral magnetically controlled cores 2 and 3, the central magnetically controlled core 9, and the gaps therebetween. In the initial state, said peripheral magnetically controlled cores 2 and 3 are separated from the central magnetically controlled core 9 by an initial gap $\delta_H$. Hence, the gap between the peripheral magnetically controlled cores 2 and 3 is equal to 2 $\delta_H$. As the magnetizing force provided by the coil 26 increases, the intensity of the magnetic flux increases, too, this bringing about an increase in the force of attraction between the overlapping ends of the central magnetically controlled core 9 and the peripheral magnetically controlled cores 2 and 3 due to their bending strain and, as a result, narrowing of the initial gap $\delta_H$ therebetween.

As the width of said gaps reaches a value equal to that of a gap which we have termed as a "tripping gap" $\delta_{cp}$, it diminishes stepwise to zero at an invariable magnetizing force provided by the coil 26 and determined by its ampere-turns which are known as operation ampere-turns. The peripheral magnetically controlled cores 2 and 3 come in contact with the central magnetically controlled core 9. As the magnetizing force diminishes to a certain value, the peripheral magnetically controlled cores 2 and 3 come out of contact with the central magnetically controlled core 9. The ampere-turns of the magnetizing coil 26 ensuring such a value of the magnetizing force are commonly known as release ampere-turns or trip ampere-turns. Thus, as the magnetically controlled cores move towards each other, the gaps between the peripheral magnetically controlled cores 2 and 3 and the central magnetically controlled core 9 are bridged. This feature of the electromagnetic device makes it possible to switch higher voltage applied to the peripheral magnetically controlled cores 2 and 3.

Figure 18:
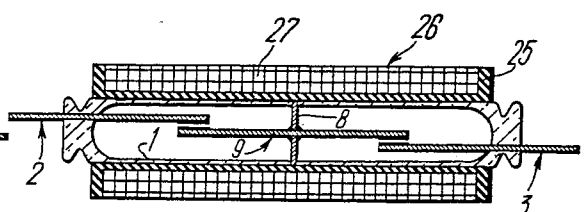
FIG. 18 is a longitudinal section view of another embodiment of the electromagnetic device, according to the invention.
Figure 17:
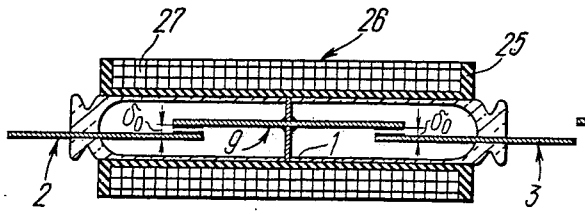
FIG. 17 shows, in longitudinal section, an electromagnetic device using a hermetically sealed contact, with a magnetizing coil, according to the invention.

The electromagnetic device shown in FIG. 18 is similar to that shown in FIG. 17 with the difference that it is built around the hermetically sealed contact of FIG. 7.

The electromagnetic device of FIG. 18 operates similarly to that of FIG. 17. The difference in the operation of both is due to the use of a different hercon. As the magnetizing force is increased, the central magnetically controlled core 9 turns in the elastic supporting member 8 made in the form of a diaphragm and brings the peripheral magnetically controlled cores 2 and 3 in contact. A decrease in the magnetizing force after the magnetically controlled cores have been brought in contact causes the central magnetically controlled core 9 and the peripheral magnetically controlled cores 2 and 3 to come out of contact. As compared to the previously described electromagnetic device shown in FIG. 17, the responsiveness of that shown in FIG. 18 is substantially higher.

Figure 19:
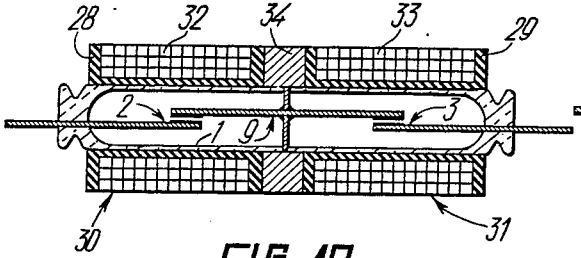
FIG. 19 shows, in longitudinal section, an embodiment of the electromagnetic device with two magnetizing coils, according to the invention.

The electromagnetic device illustrated in FIG. 19 is built around the hercon of FIG. 1. Fitted on the capsule 1 are forms 28 and 29 of two magnetizing coils 30 and 31 with windings 32 and 33, respectively. The windings 32 and 33 are connected to one or more power supply (not shown). Arranged between the ends of the forms of the magnetizing coils 30 and 31 on the capsule 1 is a ferromagnetic shunt 34 in the form of a cylinder.

The electromagnetic device of FIG. 19 operates as follows. As control signals are applied to the magnetizing coils 30 and 31, they generate magnetic fluxes. The magnetic fluxes act upon the central magnetically controlled core 9 and peripheral magnetically controlled cores 2 and 3 in the direction of their closure with the result that the peripheral magnetically controlled cores 2 and 3 are brought in contact with the central magnetically controlled core 9. Thus, with the presence of a lead (not shown) going to the central magnetically controlled core 9, a two-input logical AND function is performed (with the input of each magnetizing coil serving as the control input). Bringing the peripheral magnetically controlled cores 2 and 3 in contact outside the capsule 1 (not shown) makes it possible to perform a logical OR function. The ferromagnetic shunt 34 permits of distributing the action of the magnetic fluxes of each magnetizing coil 30 and 31 between the magnetically controlled cores 2, 3 and 9.

The electromagnetic device built around the hercon of FIG. 7 comprises, in an alternative embodiment (FIG. 20), forms 35 and 36 of magnetizing coils 37 and 38 with windings 39 and 40, respectively. The forms 35 and 36 are fitted on the capsule 1 and have slots 41 and 42 receiving a cylindrical ferromagnetic tube 43 also fitted on the capsule 1 and having its ends bevelled in parallel planes inclined with respect to the axis of the ferromagnetic tube 43. Each bevelled end 44 and 45 of the ferromagnetic tube 43 lies in the longitudinal plane of symmetry of the central magnetically controlled core 9 and faces the contact surface of the peripheral magnetically controlled core 2 or 3 nearest thereto. The provision of the ferromagnetic tube 43 permits the initial gaps between the magnetically controlled gaps to be widened. The ferromagnetic tube 43 is threaded and is adapted to be moved along the capsule 1. This can be done with the aid of a ferromagnetic shunt screwed on the ferromagnetic tube 43 and arranged between the ends of the magnetizing coils 37 and 38. The ferromagnetic tube 43 and form 35 have keyways made lengthwise therein (not shown) receiving a key 47. The ferromagnetic shunt 46 and ferromagnetic tube 43 form, through a threaded joint, an assembly ensuring the movement of the ferromagnetic tube 43 along the capsule 1, and the key 47 prevents the tube 43 from rotation. Thus, when the shunt 46 is rotating, the key 47 fixes the tube 43 so that it can only move along the axis of the capsule 1. The windings 39 and 40 are connected to a power supply (not shown).

Figure 20:
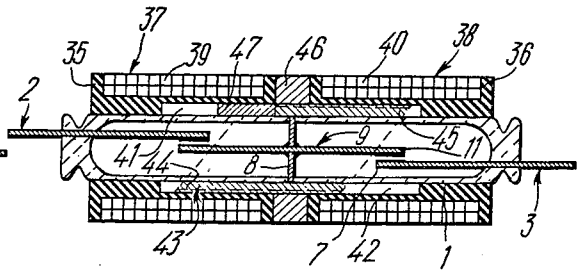
FIG. 20 shows, in longitudinal section, an embodiment of the electromagnetic device with two magnetizing coils and a ferromagnetic tube, according to the invention.

The electromagnetic device shown in FIG. 20 is basically similar to that of FIG. 19 in operation with the difference that when a logical AND function is sequentially performed (provided there is a lead, which is not shown in the drawing, going to the central magnetically controlled core 9), first the peripheral magnetically controlled core 2 is brought in contact with the central magnetically controlled core 9, the latter bends the elastic supporting member 8, turns and is ready to come in contact with the peripheral magnetically controlled core 3 as the gap between the overlapping ends 7 and 11 is gradually closed. This improves the responsiveness of the electromagnetic device. By turning the ferromagnetic shunt 46 one can move the ferromagnetic tube 43 along the capsule 1, whereby the closure characteristics of each peripheral magnetically controlled core 2 and 3 with the central magnetically controlled core 9 are equalized due to a variation in the distribution of the magnetic fluxes.

The electromagnetic device built around the hercon with two central magnetically controlled cores 9 and 13, comprises forms 48, 49 and 50 (FIG. 21) of magnetizing coils 51, 52 and 53 with windings 54, 55 and 56, respectively. The forms 48, 49 and 50 are fitted on the capsule 1 and have slots (not shown) on their inner surface receiving ferromagnetic tubes 57 and 58 similar in design to the above-described ferromagnetic tube 43 except that they are not threaded. The coils 51, 52 and 53 are separated by ferromagnetic shunts 59 and 60 disposed between the ends of their formers 48, 49 and 50. The windings 54, 55 and 56 are connected to one or more power supplies (not shown).

Figure 21:
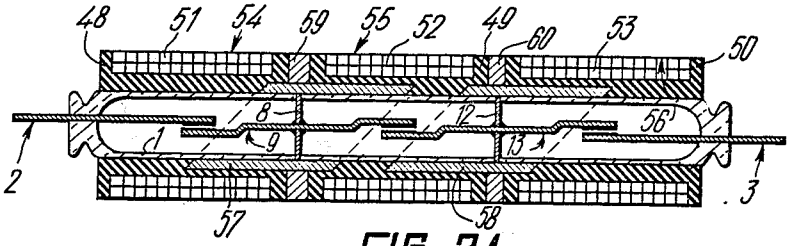
FIG. 21 shows, in longitudinal section, an embodiment of the electromagnetic device with three magnetizing coils, according to the invention.

The operation of the electromagnetic device shown in FIG. 21, in which those portions of the central magnetically controlled cores 9 and 13 which are disposed between the elastic supporting members 8 and 12 are made from a ferromagnetic material, differs from that of the above-described ones in the following.

When control signals are applied to the magnetizing coils 54, 55 and 56 (provided there are leads, which are not shown in the drawing, going to the central magnetically controlled cores 9 and 13), a three-input logical AND function is performed. In this case, the inputs of the magnetizing coils 54, 55 and 56 serve as the control inputs of the electromagnetic device, and the peripheral magnetically controlled cores 2 and 3 serve as the output of the device. The logical AND function is performed when the peripheral magnetically controlled core 2 is brought in contact with the central magnetically controlled core 9, the peripheral magnetically controlled core 3 comes in contact with the central magnetically controlled core 13, and the central magnetically controlled cores 9 and 13 come in contact. A logical OR function is performed through an electrical connection between respective peripheral magnetically controlled cores 2 and 3 and the central magnetically controlled cores 9 and 13, as well as between the central magnetically controlled cores 9 and 13.

Since in the electromagnetic device the peripheral magnetically controlled core 2, central magnetically controlled cores 9 and 13, and the peripheral magnetically controlled core 3 are arranged in that order, the logical OR function is performed selectively for two inputs. The logical OR function is performed when control signals are applied either to the coils 54 and 56 or to the coils 54 and 55 or to the coils 55 and 56. For example, to perform the logical OR function with the aid of the coils 54 and 56, the leads (not shown) should be interconnected outside the capsule 1. The peripheral magnetically controlled cores 2 and 3 should be interconnected in the same fashion.

This electromagnetic device can be advantageously used in a relay with a minimized vibration (rattling) of the cores being closed. In this case, used as the relay makes contacts are the open central magnetically controlled cores 9 and 13 which are brought closer together by energizing the magnetizing coils 54 and 56, said cores closing and being kept closed by energizing the magnetizing coil 55. The presence of the ferromagnetic shunts 59 and 60 makes it possible to enhance the responsiveness (rate of closure) of the peripheral magnetically controlled cores 2 and 3 and the central magnetically controlled cores 9 and 13, as well as to properly distribute the magnetic fluxes of each magnetizing coil 54, 55 and 56 between the magnetically controlled cores 2, 9, 13 and 3. Making the central magnetically controlled cores 9 and 13 stepped renders the electromagnetic device capable of performing a multi-input logical AND function.

The electromagnetic device built around the hercon shown in FIG. 6 comprises two magnetizing coils 30 and 31 (FIG. 22) having forms 28 and 29 as well as windings 32 and 33. The forms 28 and 29 are fitted on the capsule 1 and separated by the ferromagnetic shunt 34 placed between the ends of the forms 28 and 29 of the coils 30 and 31. The shunt 34 is provided with a slot 61 receiving a lead 62 which goes to the central magnetically controlled core 9.

Figure 23:
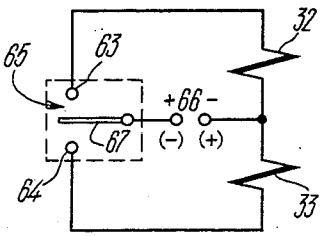
FIG. 23 is an electric circuit diagram of the electromagnetic device of FIG. 22.
Figure 22:
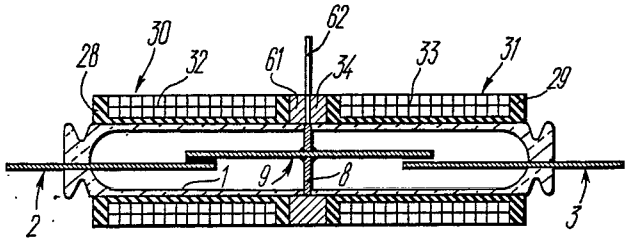
FIG. 22 is a longitudinal section view of an alternative embodiment of the electromagnetic device, according to the invention.

FIG. 23 is an electric circuit diagram of the electromagnetic device of FIG. 22. As can be seen from this diagram, the windings 32 and 33 are connected to each other and to switched leads 63 and 64 of a noncontact flip-flop 65. A power supply 66 is connected between the common point of the windings 32 and 33 and a switching lead 67 of the noncontact flip-flop 65.

The operation of the electromagnetic device illustrated in FIG. 22 should be considered in conjunction with the electric circuit diagram of FIG. 23.

In the initial or off state, the central magnetically controlled core 9 (FIG. 22) is in contact with the peripheral magnetically controlled core 2, the power source 66 (FIG. 23) is connected to the lead 63 via the switching lead of the non-contact flip-flop 65 and to the winding 32 of the magnetizing coil 30 (FIG. 22). In this state, the electromagnetic device ensures electrical connection between the peripheral magnetically controlled core 2 and the central magnetically controlled core 9 through the lead 62.

When a control signal is applied to the magnetizing coil 31, with the aid of the switching lead 67 connected to the lead 64 of the noncontact flip-flop 65 (FIG. 23) the central magnetically controlled core 9 (FIG. 22) bends the elastic supporting member 8, comes out of contact with the peripheral magnetically controlled core 2 and comes in contact with the peripheral magnetically controlled core 3. This is how the electrical connection between the peripheral magnetically controlled core 3 and the central magnetically controlled core 9 is effected through the lead 62. The mobility of the central magnetically controlled core 9 is ensured, mainly, by the elasticity of the supporting member 8. This permits, with the same size of the electromagnetic device, of improving the responsiveness of the device and, with the same responsiveness, of cutting down the size and weight thereof, i.e., forced opening of the closed cores makes the requirements as to their rigidity less stringent.

The use of the potentially controlled noncontact flip-flop 65 in the electromagnetic device (FIG. 22) renders the latter more responsive.

The electromagnetic device using the hercon of FIG. 7 comprises, in an alternative embodiment, the magnetizing coil 26 (FIG. 24) with the former 25 and winding 27. The former 25 is fitted on the capsule 1. Wound on the same former 25 in addition to the winding 27 is a winding 68 of an additional magnetizing coil 69 surrounding, along with the coil 26, the peripheral magnetically controlled cores 2 and 3 as well as the central magnetically controlled core 9. The winding 27 is separated from the winding 68 by an insulating spacer 70. The winding 27 is connected to a power supply (not shown), and the winding 68 is connected to an additional power supply (not shown).

Figure 24:
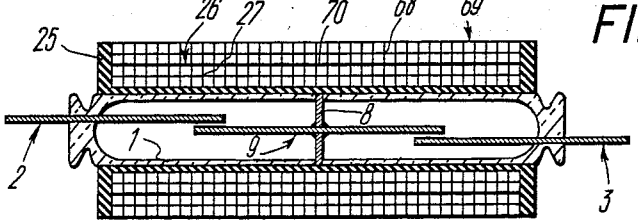
FIG. 24 shows, in longitudinal section, an embodiment of the electromagnetic device with an additional magnetizing coil, according to the invention.

Experiments have shown that the responsiveness of the proposed electromagnetic devices can be substantially enhanced if they are provided with the additional magnetizing coil 69, as is shown in FIG. 24, connected to said additional power supply (not shown). As a result of these experiments it has been established that a sizable increase in the ampere-turns of the magnetizing coils 26 and 69 is accompanied by an insignificant decrease in the total gap between the magnetically controlled cores 2, 9 and 3, as can be inferred from FIG. 25. The following are the symbols used in FIG. 25; $\delta$ is the total gap between the magnetically controlled cores 2, 9 and 3 coming in contact, which total gap is made up of the gap between the magnetically controlled cores 2 and 9 and that between the magnetically controlled cores 3 and 9; $\delta_o$ is the initial total gap between said magnetically controlled cores 2, 3 and 9; $\delta_3$ is the total "tripping" gap or the total operation gap; $\delta_2$ is the total release gap, i.e., a total gap which is set between the magnetically controlled cores 2, 9 and 3, 9 after they have come out of contact; $\delta_1$ is the total gap set between the magnetically controlled cores after applying an additional magnetomotive force in the form of ampere-turns $IW_1$ produced by the additional magnetizing coil 69; $IW_2$ are the release ampere-turns; $IW_3$ are the operation ampere-turns; IW are ampere-turns. The operation ampere-turns $IW_3$ and release ampere-turns $IW_2$ are produced by the magnetizing coils 26 and 69. Analysis of the characteristics of the proposed electromagnetic device (FIG. 25) suggests that in case of a permanent presence of the additional ampere-turns $IW_1$, the magnitude of the ampere-turns required for the hermetically sealed contact to operate and produced by the magnetizing coil 26 is determined by the difference between the operation ampere-turns $IW_3$ and additional ampere-turns $IW_1$. A considerable decrease in the operation ampere-turns (approximately twofold) substantially allays the requirements imposed on the power supply which is a source of control signals, as well as permits of increasing the load switching frequency.

Figure 25:
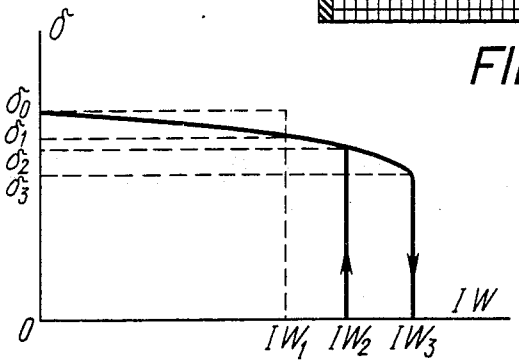
FIG. 25 is a graph showing the width of the gap between closing magnetically controlled cores versus ampere-turns (magnetomotive force)

The above-mentioned distinctive feature of the magnetically controlled cores coming close together in the electromagnetic device illustrated in FIG. 24 is inherent in the prior art electromagnetic devices using hermetically sealed contacts, as well. In other words, the curve shown in FIG. 25 is also true for any pair of overlapping anchored magnetically controlled cores. Besides, the function of the additional magnetizing coil 69 may be performed by a permanent magnet placed in direct proximity to the hermetically sealed contact and bringing the latter from the point 0, $\delta_o$ to the point $IW_1$, $\delta_1$ of the curve of FIG. 25.

The electromagnetic device using the hercon shown in FIG. 13 comprises two magnetizing coils 71 and 72 (FIG. 26) on forms 73 and 74 and with winding made up of sections 75, 76 and 77, 78. The forms 73 and 74 are fitted on the capsule 1. The sections 75 and 76 of the winding of the coil 71 are wound on the form 73 and separated by an insulating spacer 79. The sections 77 and 78 of the winding of the coil 72 are wound in the form 74 and separated by an insulating spacer 80. The coils 71 and 72 are separated by a ferromagnetic shunt 81 disposed on the capsule 1 between the ends of the forms 73 and 74 of said coils.

Figure 26:
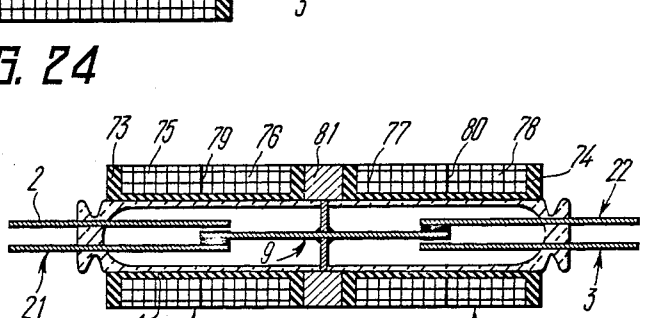
FIG. 26 is a longitudinal section view of an embodiment of the electromagnetic device with two magnetizing coils sectionalized lengthwise, according to the invention.

The electromagnetic device of FIG. 26 is designed to perform logical functions. To perform the functions of a memory, the magnetically controlled cores 2, 3 and 9 are made from a highly remanent material with a medium coercive force, e.g. alloys known under the brand names of "Remendur" and "Nibcolloy". The device is controlled by the known method of controlling memory elements of the "ferreed" type with the aid of signal combinations in the sections 75, 76, 77 and 78. To open the circuit between the peripheral nonferromagnetic cores 21 and 22 close the circuit between the peripheral magnetically controlled cores 2 and 3, signals are applied to the winding sections so that the magnetizing forces therein are aligned. After the control signals are removed, the central magnetically controlled core 9 remains closed with the peripheral magnetically controlled cores 2 and 3. To open the magnetically controlled cores 2, 3 and 9, the magnetizing forces in the sections 75 and 76 as well as those in the sections 77 and 78 should oppose one another.

Figure 27:
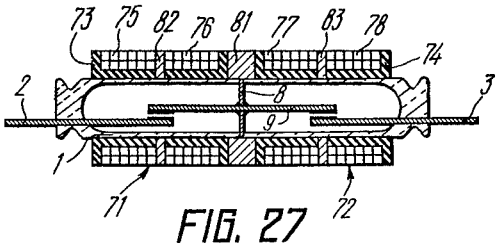
FIG. 27 shows, in longitudinal section, another embodiment of the electromagnetic device with two magnetizing coils sectionalized lengthwise, according to the invention.

The electromagnetic device shown in FIG. 27 is similar to that of FIG. 26 with the difference that it is built around the hermetically sealed contact shown in FIG. 1, and used instead the insulating spacers 79 and 80 are ferromagnetic shunts 82 and 83. It should also be noted that the sections 75, 76 and 78 of the coils 71 and 72 are wound in an aiding relationship, while the section 77 is wound in an opposing relationship thereto.

Figure 28:
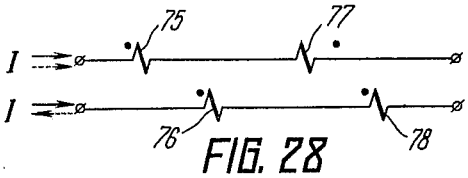
FIG. 28 is an electric circuit diagram showing the connection between the windings of the magnetizing coils of the electromagnetic device of FIG. 27.
Figure 29:
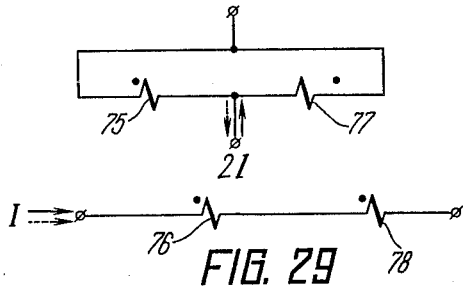
FIG. 29 is an electric circuit diagram showing an alternative variant of connection between the windings of the magnetizing coils of the electromagnetic device of FIG. 27.

The control circuit of the electromagnetic device of FIG. 27 actually consists of two parts (FIGS. 28 and 29). The first part (FIG. 28) includes the series opposing sections 75 and 77, while the second part includes the series aiding sections 76 and 78. The control circuit of FIG. 29 differs from that of FIG. 28 in that in the first part thereof the sections 75 and 77 are placed in parallel. The second part of the control circuit of FIG. 29 is similar to that of FIG. 28.

If the sections 75, 76, 77 and 78 have an equal number of turns, to bring the central magnetically controlled core 9 in contact with the left peripheral magnetically controlled core 2 (FIG. 27) and bring the central magnetically controlled core 9 out of contact with the right peripheral magnetically controlled core 3, applied to both parts of the control circuit of FIG. 28 at the same time should be current signals of the same duration and value I in the direction shown in the drawing by solid arrows.

To bring the central magnetically controlled core 9 in contact with the right peripheral magnetically controlled core 3 and bring it out of contact with the left peripheral magnetically controlled core 2, simultaneously applied to both parts of the control circuit of FIG. 28 should be current signals of the same duration and value I in the direction shown by dotted arrows. To bring the central magnetically controlled core 9 out of contact with both peripheral magnetically controlled cores 2 and 3, a 2I current signal should be applied, as is shown in FIG. 29, to the first part of the control circuit, and an I current signal should be applied to the second part thereof, both signals having the same duration and being sent at the same time in the direction shown by solid arrows. To bring the central magnetically controlled core 9 in contact with both peripheral magnetically controlled cores 2 and 3, a 2I current signal should be applied, as is shown in FIG. 29, to the first part of the control circuit, and at the same time an I current signal should be applied to the second part thereof, both signals having the same duration and following the path indicated by dotted arrows.

Both electromagnetic device control circuits shown in FIGS. 28 and 29 provide for the invariability of the position occupied by the central magnetically controlled core 9 under the action of the current signals applied thereto. This is precisely how the proposed electromagnetic device performs the functions of a memory.

All the above-described embodiments of electromagnetic devices using hermetically sealed contacts can be rendered more versatile if they are made with leads going to the central magnetically controlled cores.

To control the electromagnetic device shown in FIGS. 22 and 23, a magnetomotive force in the form of ampere-turns is produced by the magnetizing coil 31 surrounding portions of the central magnetically controlled core 9 and peripheral magnetically controlled core 3 being closed. At the same time, another magnetomotive force, also in the form of ampere-turns, is derived at the magnetizing coil 30 surrounding portions of the central magnetically controlled core 9 and peripheral magnetically controlled core 2 being opened. Such controlling is in some cases accompanied by multiple high-frequency opening of the closing central magnetically controlled core 9 and the peripheral magnetically controlled core 3 before they finally close. This is what is widely known as contact bounce. The bounce time constitutes a major portion of the operation time of an electromagnetic device using a hermetically sealed contact, the operation time being the time period from the moment a control constant voltage signal is applied to the magnetizing coil to full closure of the open central magnetically controlled core 9 and the peripheral magnetically controlled core 3. Contact bounce not only increases the operation time of an electromagnetic device using a hermetically sealed contact, but also shortens its service life due to additional mechanical wear of contacts plus wear caused by arcing between the closing contacts.

The proposed method for controlling an electromagnetic device using a hermetically sealed contact makes it possible to ensure practically vibrationless and fast switching conditions, i.e., to minimize the time required for the central magnetically controlled core 9 to move from one stable position to the other.

The proposed method is based on the theory and methods of optimum control and their integral part, dynamic programming.

The above-mentioned known methods of control require a bipolar magnetomotive force.

Figure 30:
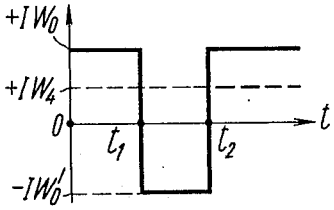
FIG. 30 is a graph illustrating the variation of the magnetomotive force in time.

The bipolarity of variation of the magnetomotive force presupposes acceleration of the opening magnetically controlled cores to a preset maximum rate of opening with a limit value of magnetomotive force $IW_o$, as well as changing over to an inverse (of opposite polarity) limit value of magnetomotive force $-IW_o$ which causes the closing magnetically controlled cores to decelerate from a moment $t_1$ to a preset rate of closure at a moment $t_2$ of their final contact. The limit values of the magnetomotive forces $IW_o$ and $IW'_o$ are restricted, mainly, by the permissible heating of respective magnetizing coils 30 and 31. The preset rate of closure of the closing central magnetically controlled core 9 and peripheral magnetically controlled core 3 at the moment $t_2$ of their contact does not exceed the value at which a bounce takes place. The variation of such a magnetomotive force in time is represented in the graph of FIG. 30.

As the closing cores come in contact at the moment $t_2$, the polarity of the magnetomotive force is reversed back to positive, and the value of the magnetomotive force is set at a lower level $IW_4$ whereat the closed magnetically controlled cores are held in contact at a preset contact pressure.

However, the above method of optimally controlling a magnetically controlled hermetically sealed contact necessitates, as has already been stated above, complicated means for its realization.

This is chiefly due to the necessity of removing and reapplying the magnetomotive force at present moments $t_1$ and $t_2$.

The herein proposed method for optimally controlling electromagnetic devices can be realized by much simpler means.

Figure 31:
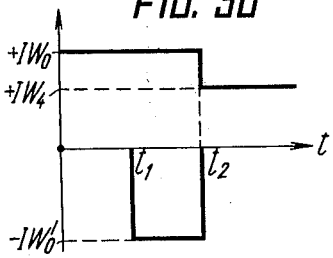
FIG. 31 is another graph showing the variation of the magnetomotive force in time.

The proposed method presupposes a main magnetomotive force $+IW_o$ and an additional magnetomotive force $-IW'_o$ force acting upon the magnetizing coils 30 and 31 (FIG. 22). The variation of said magnetomotive forces in time is represented in the graph of FIG. 31.

When the rate of displacement of the closing ends of the central magnetically controlled core 9 and peripheral magnetically controlled core 3 reaches a preset maximum value after a period of time $t_1$ following the application of the magnetomotive force $+IW_o$, an additional magnetomotive force $-IW'_o$ in the form of a magnetic flux is obtained, applied to the opening ends of the central magnetically controlled core 9 and peripheral magnetically controlled core 2 in the direction of their closure, and removed nearly at the moment $t_2$ of the closing ends of the central magnetically controlled core 9 and peripheral magnetically controlled core 3 coming in contact.

The value of the magnetomotive force $+IW_o$ is varied, after removing the additional magnetomotive force $-IW'_o$, to a preset level $+IW_4$ determined by the required contact pressure of the closed ends of the central magnetically controlled core 9 and peripheral magnetically controlled core 3.

To ensure bounce-free closure of the open normally-closed ends of the central magnetically controlled core 9 and peripheral magnetically controlled core 2, the proposed method of optimal control is applied to these cores.

Figure 32:
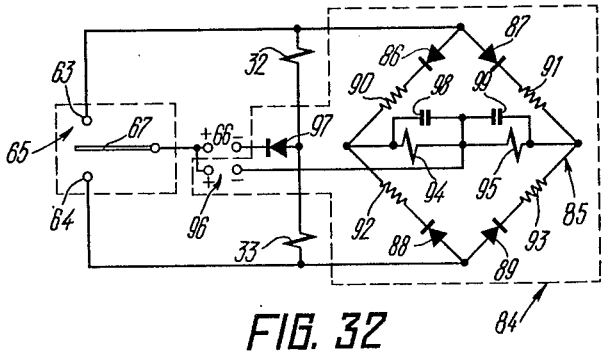
FIG. 32 is an electric circuit diagram of a means for realizing the method for controlling the electromagnetic device of FIGS. 22 and 23, according to the invention.

FIG. 32 is an electrical circuit diagram of the proposed means for quasi-optimum realization of the proposed method for controlling the electromagnetic device shown in FIGS. 22 and 23. The proposed means comprises a unit 84 (outlined with broken line in FIG. 32) complementing the device illustrated in FIG. 23. The unit 84 comprises a four-arm bridge 85, each arm whereof includes series connected diodes 86, 87, 88, 89 and resistors 90, 91, 92 and 93, respectively. Connected in series between the apices of one of the diagonals of the bridge 85 are windings 94 and 95 of two additional magnetizing coils, the common point whereof is connected to the negative terminal of an additional power supply 96. The positive terminal of the additional power supply 96 is connected to that of the power supply 66. Connected in series between the apices of the other diagonal of the bridge 85 are the windings 32 and 33 of the magnetizing coils 30 and 31. The common point of the windings 32 and 33 of the magnetizing coils 30 and 31 is connected to the negative terminal of the power supply 66 via a conducting diode 97. Each of the windings 94 and 95 of the additional magnetizing coils is shunted by capacitors 98 and 99, and is arranged on a respective magnetizing coil 30 and 31 (not shown in FIG. 22) in an aided relationship therewith.

The proposed means (FIG. 32) operates as follows.

When a control signal is applied to the potentially controlled flip-flop 65, it connects the power supply 66 to one of the windings 32 or 33.

When the power supply 66 is connected to the winding 33 via the flip-flop 65, said winding produces a longitudinal magnetic field drawing the magnetically controlled cores 9 and 3 together. After a delay $t_1$ determined by the ratings of the resistor 82 and capacitor 98 (FIG. 32), the additional magnetizing coil with the winding 94 produces a longitudinal magnetic field twice as intensive as that produced by the winding 33 and directed so as to bring the magnetically controlled cores 9 and 3 apart. In essence, this causes the magnetically controlled cores 9 and 3 to decelerate to a speed close to zero at the moment $t_2$ of their closure.

After a delay $t_2$ determined by the ratings of the resistor 93 and capacitor 99 (FIG. 32), the additional magnetizing coil with the winding 95 produces a longitudinal magnetic field almost twice as intensive as that produced by the winding 33 and directed so as to keep the magnetically controlled cores 9 and 3 closed at a predetermined contact pressure.

By adjusting the resistors 92, 93 and capacitors 98 and 99, one experimentally sets the moments $t_1$ and $t_2$ (FIG. 31) at which the resulting longitudinal magnetic field has its polarity reversed, the setting being as close to the rated value as possible.

The diode 97 prevents current from flowing from the additional power supply 96 to the windings 33 and 32 if the value of its voltage exceeds that of the power supply 66.

When the power supply 66 is connected via the flip-flop 65 to the winding 32, the operating procedure of the proposed means is similar to that described above.

What is claimed is:

1. A hermetically sealed reed switch contact comprising: a capsule; at least two peripheral elastically mounted magnetically controlled cores; said peripheral magnetically controlled cores being enclosed in said capsule and permanently anchored in its ends; an elastic supporting member arranged in said capsule intermediate of the inner ends of said peripheral magnetically controlled cores; a central elastically mounted magnetically controlled core at least partially overlapping said peripheral magnetically controlled cores, the transverse elasticity of said central magnetically controlled core being higher than the elasticity of said supporting member; said central magnetically controlled core being secured symmetrically with respect to said elastic supporting member so than when a magnetic flux is applied to said cores, it gives rise to an electromagnetic force of attraction between said magnetically controlled cores, and said central magnetically controlled core comes in or out of contact with one of said peripheral magnetically controlled cores.

2. A reed switch as claimed in claim 1, wherein said elastic supporting member is in the form of a diaphragm having a diameter preferably greater than the internal diameter of said capsule, the latter being provided with an expanded portion receiving the edges of the diaphragm rigidly secured therein.

3. A reed switch as claimed in claim 1, wherein said elastic supporting member is in the form of a rectangular strip.

4. A reed switch as claimed in claim 1, wherein said elastic supporting member is in the form of a symmetric cross.

5. A reed switch as claimed in claim 1, wherein said elastic supporting member is in the form of a symmetric three-pointed star.

6. A reed switch as claimed in claim 1, wherein said elastic supporting member is made from a ferromagnetic material.

7. A reed switch as claimed in claim 1, wherein both ends of said central magnetically controlled core are arranged on one side of the longitudinal plane passing through said two peripheral magnetically controlled cores.

8. A reed switch as claimed in claim 7, wherein said central magnetically controlled core is so arranged with respect to one of said peripheral magnetically controlled cores as to form a normally closed contact therewith.

9. A reed switch as claimed in claim 6, wherein the ends of said central magnetically controlled core are arranged intermediate of the ends of said peripheral magnetically controlled cores, overlapping said central magnetically controlled core.

10. A reed switch as claimed in claim 1, wherein said central and peripheral magnetically controlled cores are made from a magnetically remanent material.

11. A reed switch as claimed in claim 1, wherein said central magnetically controlled core has a mid portion circular in cross section, while its ends being in an overlapping relationship with those of said peripheral magnetically controlled cores are made flat.

12. A reed switch as claimed in claim 1, wherein said central magnetically controlled core is rectangular in cross section, while its ends being in an overlapping relationship with those of said peripheral magnetically controlled cores form an angle of about 90° with the mid portion of said central magnetically controlled core.

13. A reed switch as claimed in claim 1, wherein the length of said central magnetically controlled core is approximately equal to the total length of the inner ends of said peripheral magnetically controlled cores.

14. A reed switch as claimed in claim 1, wherein the length of said central magnetically controlled core exceeds the total length of the inner ends of said peripheral magnetically controlled cores.

15. A reed switch comprising: a capsule; at least two peripheral elastically mounted magnetically controlled cores; said peripheral magnetically controlled cores being enclosed in said capsule and permanently anchored in its ends; an elastic supporting member arranged in said capsule intermediate of the inner ends of said peripheral magnetically controlled cores; a central elastically mounted magnetically controlled core overlapping said peripheral magnetically controlled cores and rigidly secured in said supporting member; at least one additional elastic supporting member arranged in said capsule intermediate of an end of said central magnetically controlled core and the inner end of one of said peripheral magnetically controlled cores; an additional central elastically mounted magnetically controlled core rigidly secured in said additional elastic supporting member; said central magnetically controlled cores being in an overlapping relationship.

16. A reed switch as claimed in claim 15, wherein those portions of said central magnetically controlled cores which are confined between said elastic supporting members are made from a conducting nonferromagnetic material.

17. A reed switch as claimed in claim 15, wherein each said central magnetically controlled core is made bent and stepped and is secured in the centre of said supporting member with its mid portion.

18. A reed switch as claimed in claim 15, wherein the ends of each said central magnetically controlled core, disposed on either sides of said supporting members, are equal in length.

19. A reed switch as claimed in claim 15, wherein each said central magnetically controlled core is provided with a lead.

20. A reed switch as claimed in claim 1, wherein said central magnetically controlled core is provided with a lead.

21. A reed switch as claimed in claim 1, comprising at least two peripheral elastically mounted cores permanently anchored in said ends of said capsule and made from a nonferromagnetic material, each end of said central magnetically controlled core being arranged between the end of a peripheral magnetically controlled core and that of a peripheral code made from a nonferromagnetic material, which ends are anchored in one end of said capsule, so that said central magnetically controlled core forms a normally closed contact with one of said peripheral magnetically controlled cores and a normally open contact with the other said peripheral magnetically controlled core.

22. A reed switch as claimed in claim 19, comprising at least two peripheral elastically mounted cores permanently anchored in said ends of said capsule and made from a nonferromagnetic material, each end of said central magnetically controlled core being arranged between the end of a peripheral magnetically controlled core and that of a peripheral core made from a nonferromagnetic material, which ends are anchored in one end of said capsule, so that said central magnetically controlled core forms a normally closed contact with one of said peripheral magnetically controlled cores and a normally open contact with the other said peripheral magnetically controlled core.

23. A reed switch as claimed in claim 22, wherein the contact surfaces of said central and peripheral magnetically controlled cores as well as said peripheral cores made from a nonferromagnetic material are arranged at an angle of preferably 30° to the direction of their mutual displacement.

* * * * *